US005103890A

United States Patent [19]

Cloutier

[11] Patent Number: 5,103,890

[45] Date of Patent: Apr. 14, 1992

[54] DOOR COUNTERWEIGHT SYSTEM

[76] Inventor: Hermel Cloutier, Brodie Drive, Concession 6, R.R. #4, Orillia, Ontario, Canada, L3V 6H4

[21] Appl. No.: 507,754

[22] Filed: Apr. 12, 1990

[30] Foreign Application Priority Data

Dec. 21, 1989 [CA] Canada ..... 2006373

[51] Int. Cl.[5] ..... E05F 11/00

[52] U.S. Cl. ..... 160/190; 160/193

[58] Field of Search ..... 160/201, 190, 189, 193, 160/133

[56] References Cited

U.S. PATENT DOCUMENTS

| | | | |
|---|---|---|---|
| 1,183,402 | 5/1916 | Prescott | 160/193 |
| 1,682,772 | 9/1928 | Cahill | 160/189 |
| 1,863,961 | 6/1932 | Ball et al. | 160/189 |
| 1,874,077 | 8/1932 | Anderson . | |
| 1,912,830 | 6/1933 | Crume | 160/190 |
| 1,922,370 | 8/1933 | Johnson et al. | 160/201 X |
| 2,017,012 | 10/1935 | Morgan | 160/190 |
| 2,041,410 | 5/1936 | Goodman | 160/190 X |
| 2,552,992 | 5/1951 | Michelman | 160/189 |
| 3,499,478 | 3/1970 | Schneider | 160/193 X |
| 3,981,343 | 9/1976 | DeVito | 160/190 X |
| 4,882,806 | 11/1989 | Davis | 160/201 X |
| 4,884,369 | 12/1089 | Iatham . | |

FOREIGN PATENT DOCUMENTS

| | | |
|---|---|---|
| 395509 | 3/1941 | Canada . |
| 1006599 | 4/1957 | Fed. Rep. of Germany . |
| 294386A1 | 10/1979 | Fed. Rep. of Germany . |
| G8905401.6 | 7/1989 | Fed. Rep. of Germany . |
| 1022005 | 2/1953 | France . |
| 60.858 | 2/1955 | France . |

*Primary Examiner*—David M. Purol

*Attorney, Agent, or Firm*—Hoffman, Wasson & Gitler

[57] ABSTRACT

An overhead door system employs counterweights which operate through cables connected to a drum which tapers from one end to the other so that the effective force acting on the door in the opening direction is reduced as the proportion of the weight of the door to be supported reduces. The system is adjustable readily to accommodate different types of doors having different opening characteristics in terms of the proportion of the doors weight that must be counterbalanced at different stages of the door opening movement.

11 Claims, 4 Drawing Sheets

DOOR COUNTERWEIGHT SYSTEM

BACKGROUND OF THE INVENTION a) Field of the Invention

This invention relates to a new or improved counterbalance system for use in overhead doors, to a drum for use therein, and to a door installation employing such system.

b) Description of the Prior Art

Over the years, numerous designs of counterbalance systems for upwardly opening or overhead doors have been devised, and examples are shown in various prior patents, such as U.S. Pat. No. 1,469,542 Storms, U.S. Pat. No. 1,603,379 Dautrick and U.S. Pat. No. 3,094,163 Herber, and more recently, an earlier design of my own shown in U.S. Pat. No. 4,887,658. The door opening arrangements disclosed in the foregoing patents make use of weights to provide the counterbalance force required during door opening. Door opening systems employing springs to provide the counterbalance force are well known, and are widely used, particularly in domestic garage doors.

Various forms of torsion or tension springs may be employed utilizing systems of cables and pulleys to transmit the spring force to the door. Spring operated counterbalance systems for doors tend to be troublesome to install, and while such systems are often not unduly expensive, they can be troublesome from the point of view of maintenance, and are subject to failure, for example through fracture of a spring or the like. Furthermore, with spring counterbalance systems it is difficult if not impossible to ensure that the spring force is accurately matched to the door load throughout the range of door opening movement.

SUMMARY OF THE INVENTION

The present invention provides a counterbalance system for an overhead door, such door being movable from a closed position wherein it is arranged in a generally vertical orientation closing a doorway and an open position wherein it is disposed above said doorway and at least partially horizontally oriented, guide means acting between the lateral edges of the door and the sides of the doorway to guide the door in its movement between open and closed positions, said counterbalance system comprising: a spool adapted to be rotatably mounted on a horizontal axis on the structure surrounding the doorway and cable means connected to said spool and said door such that rotation of said spool in a direction to wind the cable onto the spool applied through the cable a force urging the door to move in the opening direction, the weight of the door as it moves away from the closed position being supported initially by said cable and subsequently to an increasing extent by said guide means as the door moves towards the fully open position; a winding drum fixed to rotate with said spool; an elongate flexible load transmitting element connected to said drum to unwind therefrom as said spool rotates to wind the cable thereon, and vice versa; said force-transmitting element freely suspending a counterweight such that the mass thereof provides a torque acting on said drum said spool and said cable to urge said door in the opening direction; and means for varying said torque in accordance with the rotational position of said drum and said spool, such that the opening force applied to said door diminishes in relation to the proportion of the weight of the door that is supported by said cable means.

The torque varying means preferably comprises a U-shaped channel of conico-spiral configuration to receive a force transmitting element in the form of a second cable which supports a counterweight that is raised or lowered as the drum is rotated in one direction or the other. In an alternative configuration the force transmitting element is in the form of a thick cable or belt that is wound on the drum in a single coil such that the radius at which the cable or belt winds onto the drum varies continuously as the drum rotates, and the torque applied to the drum therefore varies as a function of the thickness of the cable or belt and the length of it that is coiled onto the drum.

The spool and the drum may be separate elements each attached to a shaft that is mounted to rotate at the top of the doorway, a drum and a spool being positioned in proximity to each edge of the doorway. The force transmitting element may be a second cable that either supports the counterweight directly, or which is formed in a loop having one end anchored to the door frame, the counterweight being carried by a pulley that is supported in the loop.

Preferred embodiments of the invention as disclosed herein provide a door counterbalance system that is particularly easy to install, and that also affords a ready means of adjustment upon installation to achieve accurate counterbalancing. The disclosed counterbalance system is relatively cheap, and is safe and highly reliable in operation. The basic counterbalance system is readily adaptable to accommodate various types of overhead doors whether they be standard lift, high lift, or even vertical lift.

From another aspect the invention provides for use in a counterbalance system for a vertically movable door, a drum comprising a hub defining therein an axle bore extending from end-to-end of the drum, said drum having an outer periphery configured with a continuous groove extending generally helically thereon and progressing from one end of the drum to the other, the drum defining in the axial direction a first region wherein said groove defines a plurality of turns about the axis at a constant radius; a second region wherein the radius of said groove from said axis increases progressively from said constant radius to a maximum radius that is of the order of at least twice said constant radius, said groove continuing at said maximum radius through a plurality of turns about said axis.

Preferably there are three turns of the groove at said minimum (constant) diameter, and five or six turns at said maximum diameter. The drum is suitable for use with standard lift doors using the groove essentially only up to the end of the intermediate section. For high lift doors, a length of the groove at said maximum diameter is used, this length corresponding to the vertical lift section of the door opening movement. For purely vertical lift doors, only the maximum diameter region of the groove is used.

BRIEF DESCRIPTION OF THE DRAWINGS

The invention will further be described, by way of example only, with reference to the accompanying drawings wherein.

DESCRIPTION OF THE PREFERRED EMBODIMENTS

Figure 1:
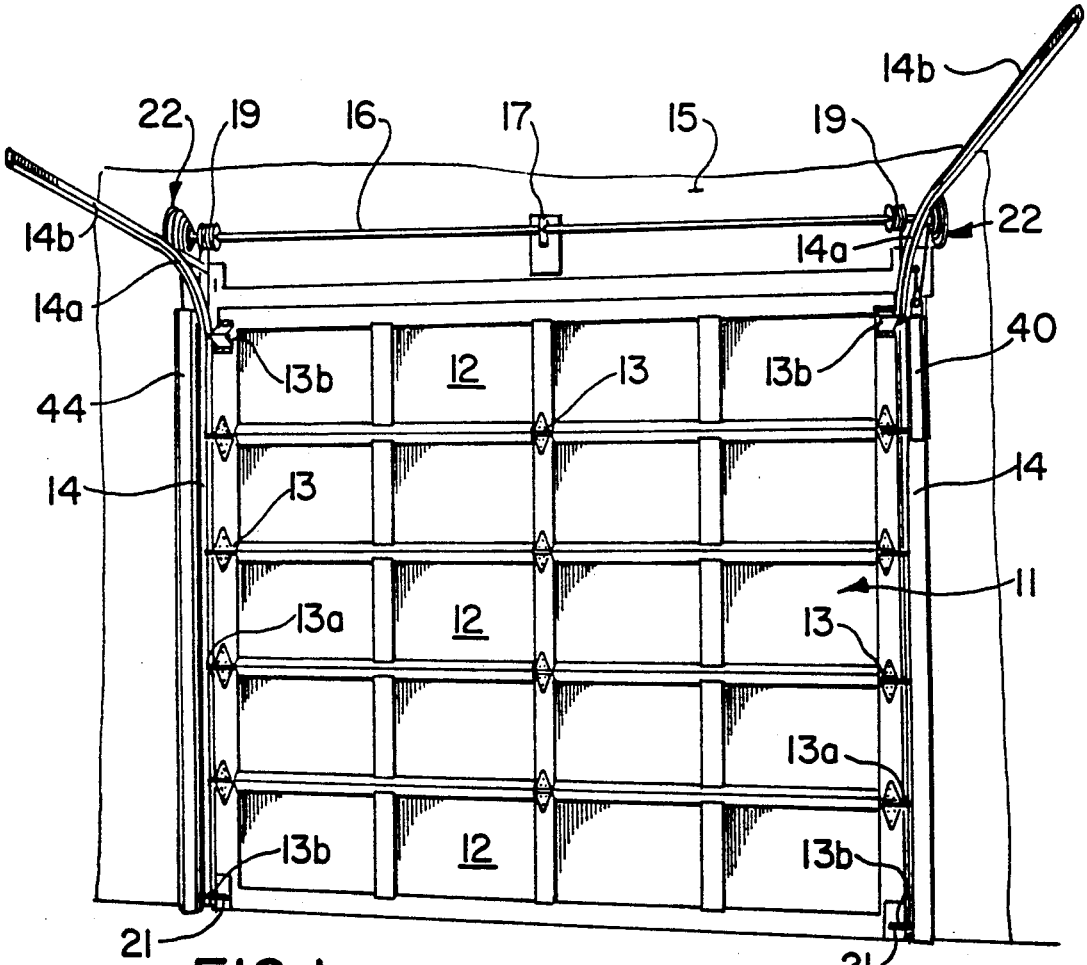
FIG. 1 is an overall perspective view from the inside of a building showing a preferred embodiment of an overhead door counterbalance system in accordance with the invention.

As shown in FIG. 1, an overhead garage door 11 is formed by a series of horizontally divided sections 12 pivotally interconnected by hinges 13. At each edge of the door the hinges carry a laterally projecting hinge pin 13*a* which in known manner supports a roller or the like (not shown) received within a track structure 14 mounted in the door frame 15 at each side of the doorway and adapted to guide movement of the door sections during opening and closing. As shown, the tracks 14 are vertically arranged and extend at their upper ends through a curved intermediate section 14*a* into a generally horizontal top section 14*b* that projects away from the doorway, the top sections being supported by any suitable means, e.g. hangers attached to a ceiling (not shown). The upper edge of the top door section and the lower edge of the bottom door section likewise carry laterally projecting pins 13*b* carrying guide means such as rollers 8 (see FIG. 3) which cooperate with the track 14.

Extending horizontally above the doorway is a shaft 16 rotatably carried in a central bearing 17 and in two lateral bearings 18 (see FIG. 3) adjacent opposite side edges of the door.

Figure 3:
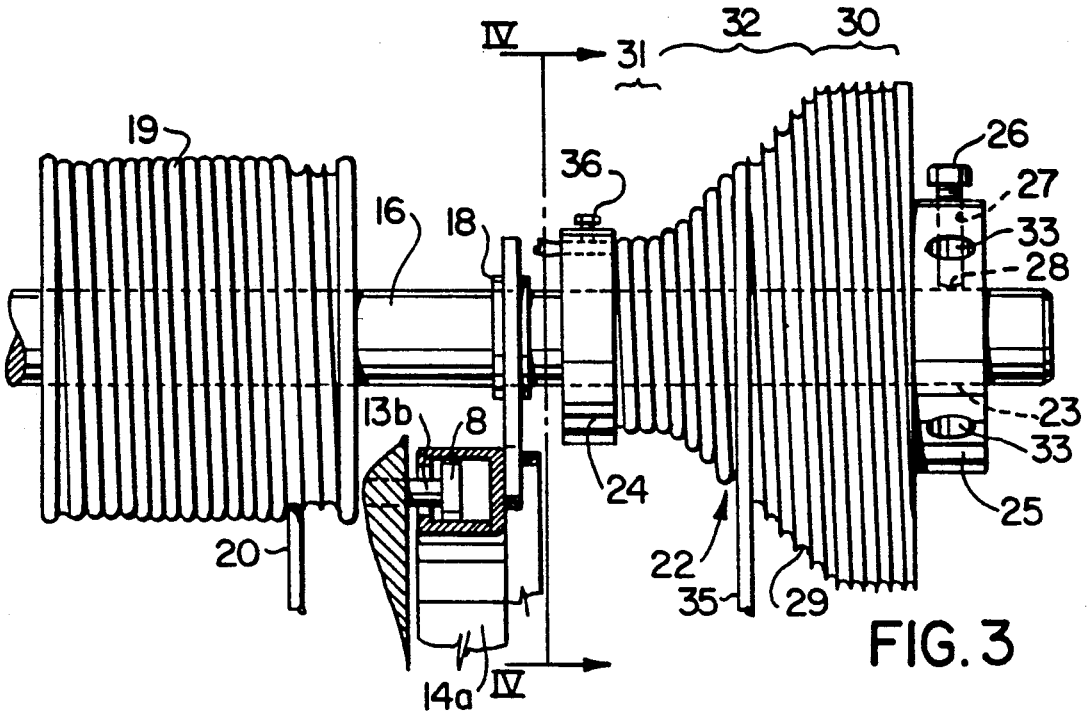
FIG. 3 is an elevational view to a larger scale showing an important part of the counterbalance system.
Figure 4:
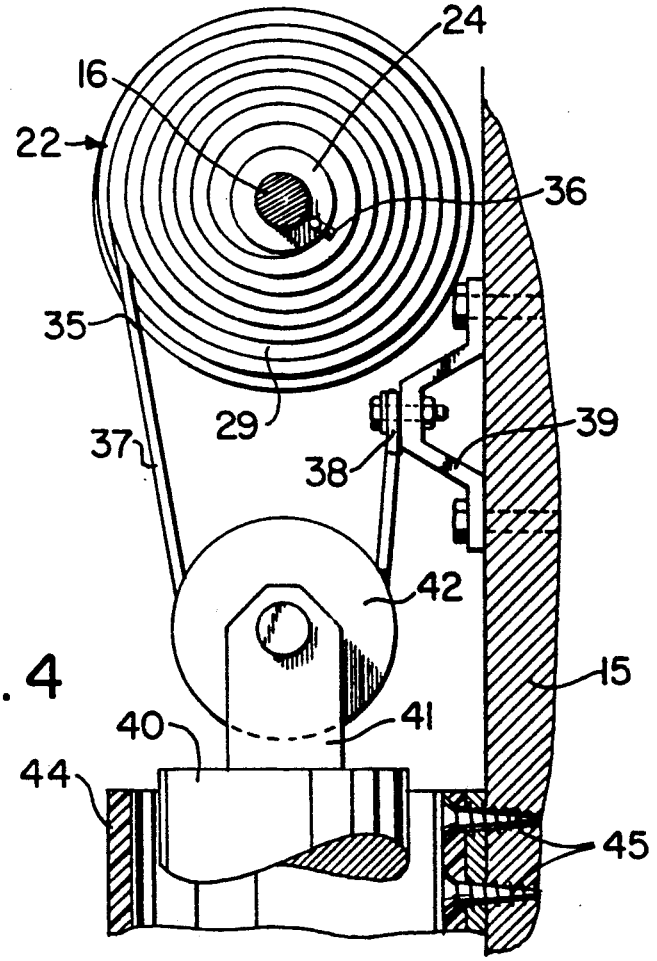
FIG. 4 is a fragmentary view taken in the direction indicated by the arrows IV—IV in FIG. 3.

Close to each end of the shaft 16 and fixed to rotate with it is a flanged cylindrical spool 19 positioned substantially in alignment with the lateral edge of the door. A cable 20 is wound on this spool and extends vertically downwards being attached at its end to a bracket 21 at the lower corner of the bottom door section. On the opposite side of the bearing 18 the shaft 16 carries a drum assembly 22 which is best seen in FIGS. 3 and 4. The drum 22 has an axial bore 23 extending therethrough between a flange 24 at one end and a collar 25 at the other. A clamping screw 26 is threaded in a radial through bore 27 in the collar 26 and can be tightened to engage its tip 28 against the surface of the shaft thereby fixing the drum 22 to rotate with the shaft. Between the flange 24 and the collar 25, the drum is of generally frusto-conical outline defined by a continuous groove 29 that extends in a spiral/helical manner from a small diameter end adjacent the flange 24 to a larger diameter end adjacent the collar 25. The radius of the groove 29 from the axis of the shaft 26 is at a maximum adjacent the collar 25, and remains constant for about 5 or 6 turns as indicated by the region 30. Adjacent the flange 24 there is a region of minimum diameter 31 extending for about 3 turns, and between these two regions is an intermediate region 32 wherein the radius of the groove changes in a continuous manner.

A cable 35 is wound onto the drum in the groove 29, one end of the cable being attached to the flange 24 by means of a grub screw 36, the cable then being laid into the groove 29 to an extent corresponding to the rotational position of the drum 22. From the drum the cable 35 descends in a loop 37 and has its opposite end 38 attached to a bracket 39 mounted on the door frame 15. An elongate counterweight 40 has a clevis 41 attached to its upper end and providing a bearing for a grooved pulley wheel 42 which runs on the cable loop 37.

Four radially extending cylindrical sockets 33 are provided spaced at 90° intervals around the periphery of the collar 25.

As shown particularly in FIGS. 1 and 4, a tubular guide housing 44 is vertically arranged adjacent each edge of the door frame 15 and is attached thereto e.g. by wood screws 45. The housings 44 guide the counterweights 40 for vertical movement therein. In addition, the housings 44 provide protection for the counterweights to ensure that their movement is unimpeded, and protect the users from inadvertent contact with the counterweights.

Figure 2:
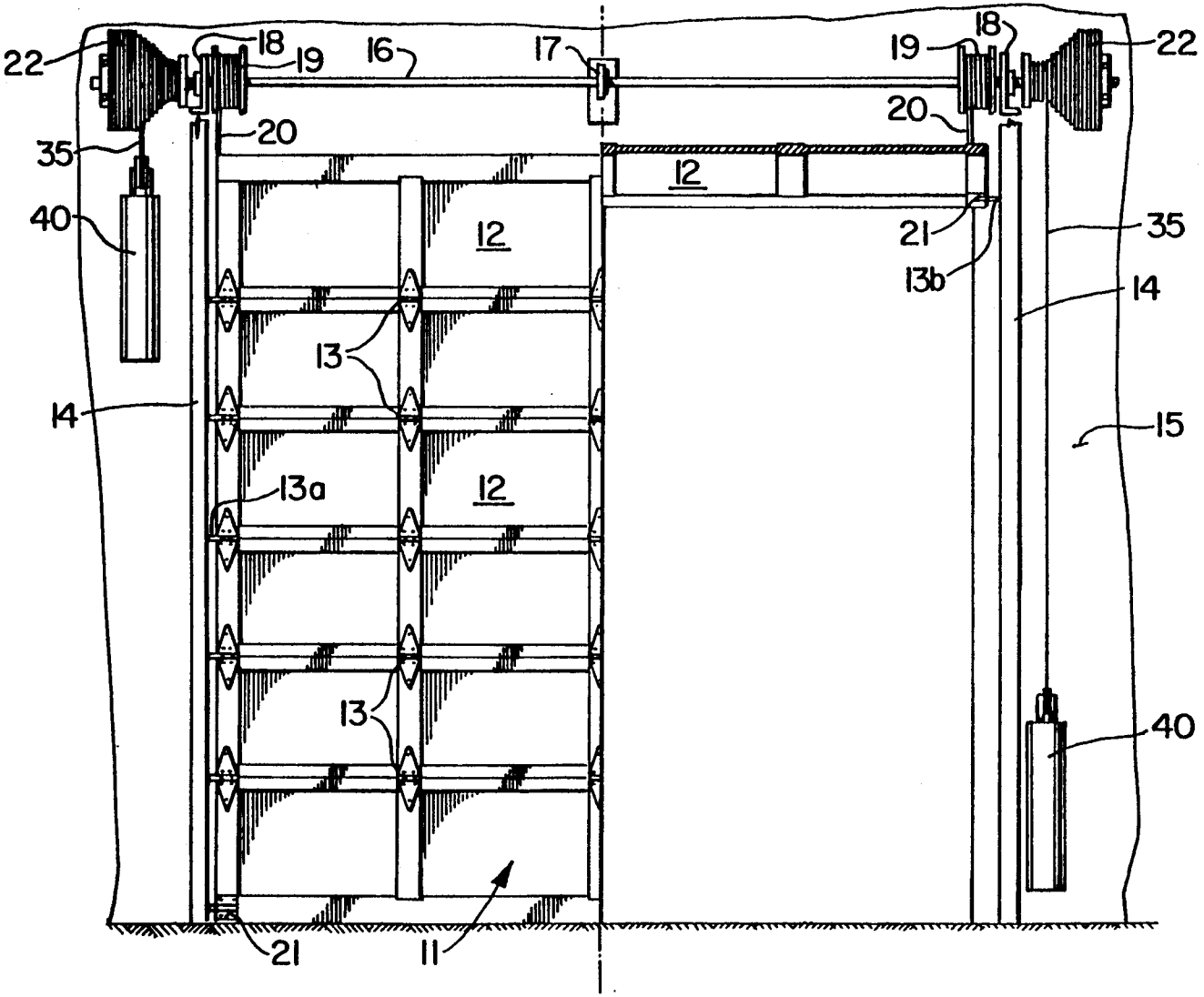
FIG. 2 is an elevational view of the door and counterbalance system with parts omitted for reasons of clarity, the door being shown in different positions in the left and right hand side of the figure.

As will be appreciated from the foregoing description, as the door 11 is moved from its closed position shown in FIG. 1 shown in the left hand side of FIG. 2, to its opened position as shown in the right hand side of FIG. 2, the door sections 12 guided by their pin mounted rollers 8 in the tracks 14, moves successively from the vertical position, around the curved track sections 14, into a substantially horizontal position wherein they are supported by the top portions 14*b* of the guides. During this movement the weight of the door 11 is substantially counterbalanced by the counterweights 40 so that the effort required to move the door from its closed to its opened position is minimal. Furthermore, this effort does not vary substantially throughout the range of opening movement of the door. This effect is achieved by careful selection of the configuration of the drums 22 and the mass of the counterweights 40 in relation to the weight of the door and the diameter of the spools 19. Thus, for example, 10 for a door 11 having a weight of say 200 pounds, each counterweight system must provide a counterbalance force of up to 100 pounds, and this force must diminish in proportion to the increasing proportion of the weight of the door that is supported by the horizontal top sections 14*b* of the track.

When the door is in the closed position as shown in the left hand side of FIG. 2, the cable 35 is wound onto the drum 22 as far as the maximum diameter region 30 of the groove 29. At this location, the lifting force applied to the cable 20 as a result of the mass of the counterweight 40 will be a function of the ratio of the spool diameter 19 to the diameter of the region 30 of the drum groove. As shown, this ratio is approximately 2:1, and therefore two counterweights 40 of mass 100 pounds each will provide sufficient force to counterbalance the full weight of the door.

As the door is opened, the cable 35 unwinds from the drum groove 29 at a progressively decreasing radius, and therefore the torque applied to the shaft 16 also progressively decreases until the minimum-radius groove region 31 is reached, at which location the cable leaves the drum at a radius very much less than the radius of the spool 19, so that the torque applied to the shaft 16 is correspondingly reduced as the door approaches its fully opened position and substantially its entire weight is supported by the top track portions 14*b*.

Adjustment of the counterbalance force can be effected quite easily if it is necessary to make slight changes to more closely match this force to the manner in which the effective weight of the door is reduced during opening. To do so, when the door is in the fully closed position, a torque bar or the like implement (not shown) can be inserted into one of the sockets 33 in the drum collar 25 and used as a torque arm to support the drum 22 against rotation under the force of the counterweight, whereupon the screw 26 can be slackened, freeing the drum relative to the shaft. The drum can therefore be rotated under control of the torque bar to vary the extent to which the cable 35 is unwound from the drum, and thus vary the torque applied to the shaft 16 through the counterweight, with the door 11 in its fully closed position. When the desired position of angular adjustment of the drum 22 has been reached, the screw 26 is re-tightened to once again clamp the drum to the shaft.

Likewise, upon installation of the counterbalance system, the counterweight 40 may simply be placed in position as shown at the right hand side of FIG. 2 and supported on a block or the like. With the shaft 16 and its spools 19 and drums 22 mounted as shown, the cable 35 can be attached to the flange 24 and wound around one or two turns of the drum, thereafter being passed downwardly around the pulley 42 and looped back to the mounting bracket 39. With the clamping screw 26 slackened, the torque bar can thus be used to rotate the drum 22 winding the cable onto it and thereby raising the counterweight 40. When the counterweight has been raised to the desired position, the screw 26 is tightened to clamp the drum to the shaft.

Figure 5:
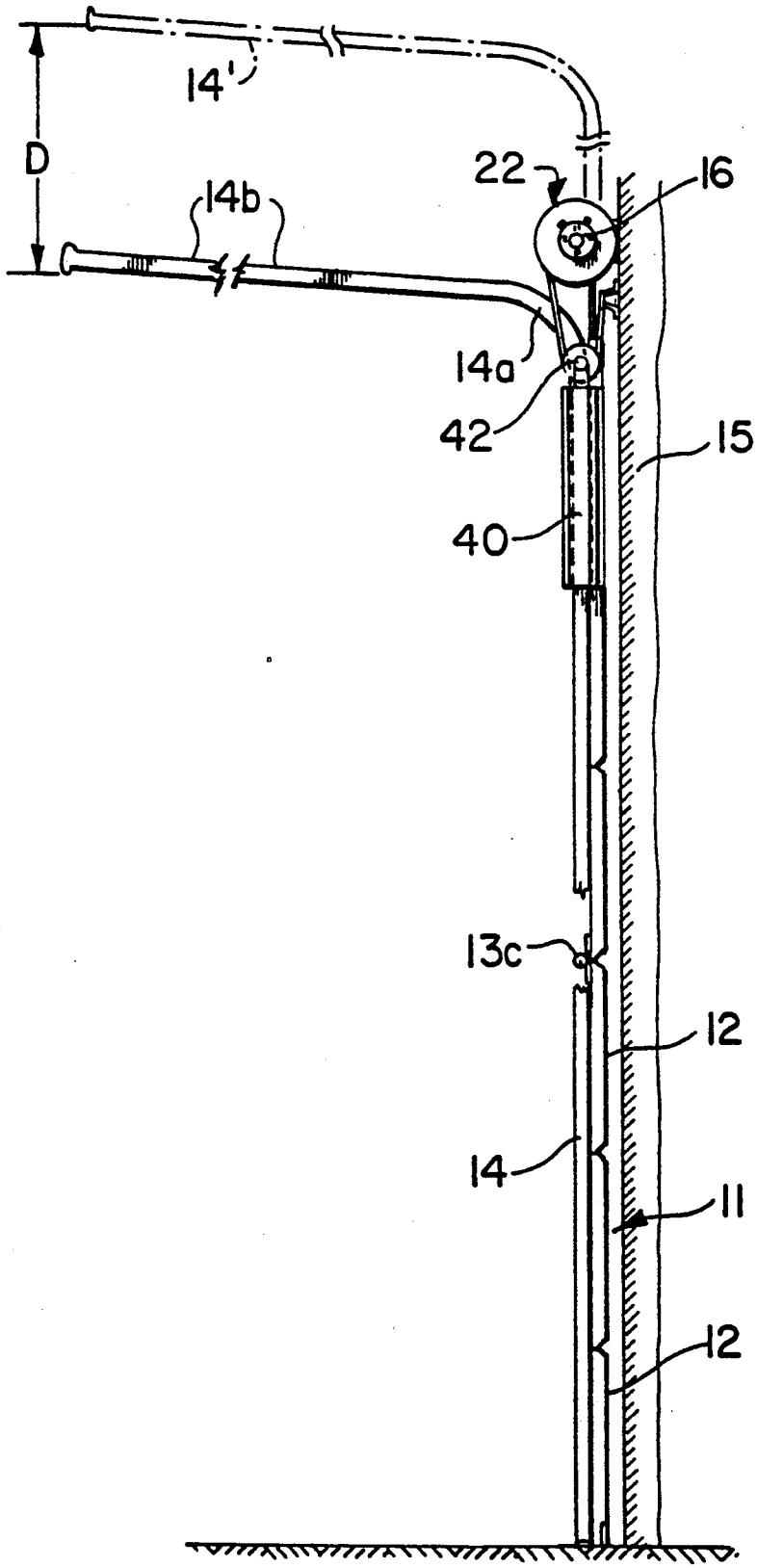
FIG. 5 is a side elevational view of the door counterbalance system.

The counterbalance system can readily be adapted for use with what are referred to as "high lift" doors, i.e. doors which upon opening initially travel vertically for a substantial distance before the door sections start to turn into the horizontal position. In such applications a track such as that shown in broken lines at 14' (FIG. 5) is utilized. It will be seen that as compared with the earlier described embodiment, in this configuration the door must be raised vertically by a distance D before the door sections start to swing out of the vertical position. This is readily accommodated by the counterbalance system shown since all that is necessary is to wind the cable 35 around the maximum diameter region of the groove 29 over a length corresponding to D. When the system is thus configured, it will be appreciated that, moving from the closed position, over the initial opening distance D. the torque applied to the drum 23 to the cable 35 will be constant, as also will be the counterbalance force applied to the door through the cables 22. This is necessary since during the initial distance D from the closed position, the entire weight of the door is supported by the cables 20.

It will be seen that with the cable 35 forming a loop 37 as shown in FIG. 4, the vertical movement of the counterweight 40 will equal approximately ½ of the length of cable unwound from the drum. It would be possible to dispense with the loop 37 and suspend the counterweight 40 directly on the cable 35. In this arrangement the full mass of the counterweight would be applied to the cable 35, but of course the vertical movement of the counterweight would correspond exactly in length to the length of cable unwound, and during unwinding, the counterweight would be subjected to greater lateral movement. The effect of lateral movement would however be rather minimal and could easily be absorbed by the guide housing 44. The guide housing could conveniently be made of a plastic tubing, e.g. of PDC, so that minimal frictional forces would be encountered.

As compared to the arrangement shown, the arrangement discussed whereby the counterweight 40 is attached directly to the cable 35 would enable one to use a counterweight that is half the mass of the counterweight 40, or alternatively would enable one to use a drum having a maximum diameter of the groove 29 approximately ½ of the diameter shown in FIG. 3.

What I claim as my invention is:

1. A counterbalance system for an overhead door, such door being movable from a closed position wherein it is arranged in a generally vertical orientation closing a doorway and an open position wherein it is disposed above said doorway and at least partially horizontally oriented, guide means acting between the lateral edges of the door and the sides of the doorway to guide the door in its movement between open and closed positions, said counterbalance system comprising:

a spool adapted to be rotatably mounted on a horizontal axis on the structure surrounding the doorway and a first cable connected to said spool and said door such that rotation of said spool in a direction to wind the cable onto the spool applies through the cable, a force urging the door to move in the opening direction, the weight of the door as it moves away from the closed position being supported initially by said cable and subsequently to an increasing extent by said guide means as the door moves towards the fully open position;

a winding drum fixed to rotate with said spool said drum comprising; a hub defining therein a longitudinal axis and an axial bore extending through said drum, said drum having an outer periphery configured with a continuous peripheral groove extending generally helically thereon and progressing from one end of the drum to the other;

said drum defining successively in the axial direction:

(1) a first region wherein said groove defines a plurality of turns about the axis at a constant radius;

(2) a second region wherein the radius of said groove from said axis increases progressively from said constant radius to a maximum radius that is at least about twice said constant radius; and (3) a third region wherein said groove continues at said maximum radius through a plurality of turns about said axis;

an elongate force-transmitting element laid in said groove to unwind said drum as said spool rotates to wind the cable thereon, and vice versa;

said force-transmitting element freely suspending a counterweight such that the mass thereof provides a torque acting on said drum, said spool, and said cable to urge said door in the opening direction, said torque having magnitude that is proportional to the radius from said axis of the point at which said force transmitting element parts from said continuous peripheral groove, such that the opening force applied to said door diminishes in relation to the proportion of the weight of the door that is supported by said cable;

said drum having associated therewith winding means comprising a plurality of formations that define locations that are angularly spaced about the axis of said drum, said formations being selectively engageable at each said location by a torquing tool by means of which the drum can be rotated about said axis.

2. A counterbalance system as claimed in claim 1 provided with a pulley extending below said drum, and wherein said drum and said spool are carried on a shaft that is mounted to rotate at the top of said doorway, said shaft also provided with a fixed mounting, said drum being positioned in proximity to one edge of the doorway, said force transmitting element comprising a second cable, said second cable lying in said groove and extending at one end therefrom in a depending loop, the opposite side of which is supported on said fixed mounting and the counterweight being suspended from said pulley carried by said loop.

3. A counterbalance system as claimed in claim 2 wherein one said drum is provided on the shaft at each side of the doorway, each drum having an associated second cable and counterweight.

4. A counterbalance system as claimed in claim 2 wherein said drum includes clamping means whereby it is adapted to be releasably coupled to rotate with said shaft, said drum being freely rotated relative to said shaft when said clamping means is releasable.

5. A counterbalance system as claimed in claim 1 including a tubular housing vertically positioned to surround and enclose the counterweight during vertical movement thereof.

6. For use in a counterbalance system for a vertically movable door, a drum comprising: a hub defining therein a longitudinal axis and an axis bore extending through said drum, said drum having an outer periphery configured with a continuous peripheral groove extending generally helically thereon and progressing form one end of the drum to the other;

said drum defining successively in the axial direction:

(1) a first region wherein said groove defines a plurality of turns about the axis at a constant radius;

(2) a second region wherein the radius of said groove from said axis increases progressively from said constant radius to a maximum radius that is at least about twice said constant radius; and (3) a third region wherein said groove continues at said maximum radius through a plurality of turns about said axis;

said drum having associated therewith winding means comprising a plurality of formations that define locations that are angularly spaced about the axis of said drum, said formations being selectively engageable at each said location by a torquing tool by means of which the drum can be rotated about said axis.

7. A drum as claimed in claim 6 wherein said hub carries means for forming a driving engagement with a shaft passed through said axis bore.

8. A drum as claimed in claim 7 wherein said means comprises a radially extending clamping screw threadedly engaged in a radial bore in said hub, said clamping screw having a tip that can be extended into said axial bore.

9. A drum as claimed in claim 6 wherein said formations comprise sockets that extend in directions substantially transverse to said axis.

10. A drum as claimed in claim 6 wherein said formations comprise radially extending sockets provided in a collar located at one end of said hub for selective engagement by a torquing tool in the form of a torque bar.

11. A drum as claimed in claim 6 wherein the length of said groove that passes through said third region of the drum corresponds to the length of said groove that passes through said second region of said drum.

* * * * *

UNITED STATES PATENT AND TRADEMARK OFFICE

CERTIFICATE OF CORRECTION

PATENT NO. : 5,103,890

DATED : April 14, 1992

INVENTOR(S) : Hermel R. Cloutier

It is certified that error appears in the above-identified patent and that said Letters Patent is hereby corrected as shown below:

Column 7:

Claim 6, line 3, change "axis" to --axial--

Claim 6, line 6, change "form" to --from--

Signed and Sealed this

Twenty-sixth Day of October, 1993

*Attest:*

*Attesting Officer*

BRUCE LEHMAN

*Commissioner of Patents and Trademarks*